US008584801B2

(12) United States Patent
Baxter

(10) Patent No.: US 8,584,801 B2
(45) Date of Patent: Nov. 19, 2013

(54) SELF-CLIMBING HOIST, DECK AND SCAFFOLD PLATFORM SYSTEM

(76) Inventor: Colonel August Baxter, Naples, FL (US)

( * ) Notice: Subject to any disclaimer, the term of this patent is extended or adjusted under 35 U.S.C. 154(b) by 0 days.

(21) Appl. No.: 13/374,451

(22) Filed: Dec. 29, 2011

(65) Prior Publication Data

US 2012/0168251 A1 Jul. 5, 2012

Related U.S. Application Data

(60) Provisional application No. 61/460,326, filed on Dec. 30, 2010.

(51) Int. Cl.
*E04G 3/20* (2006.01)
*B66C 23/34* (2006.01)

(52) U.S. Cl.
USPC ..... 182/82; 182/141; 212/180

(58) Field of Classification Search
USPC ..... 182/82, 141; 212/180
See application file for complete search history.

(56) References Cited

U.S. PATENT DOCUMENTS

| | | | | | |
|---|---|---|---|---|---|
| 1,111,099 | A * | 9/1914 | Sawyer | 212/199 |
| 2,928,556 | A * | 3/1960 | White | 212/179 |
| 3,045,837 | A * | 7/1962 | Liebherr et al. | 212/299 |
| RE25,746 | E * | 3/1965 | Gregory | 182/141 |
| 3,302,749 | A * | 2/1967 | Heaphy et al. | 182/82 |
| 3,934,729 | A * | 1/1976 | Wellman | 212/297 |
| 3,974,995 | A * | 8/1976 | Blonde | 249/19 |
| 4,496,277 | A * | 1/1985 | Jungman | 414/589 |
| 4,856,662 | A * | 8/1989 | Marvin et al. | 212/176 |
| 5,971,177 | A * | 10/1999 | Carter | 212/177 |
| 6,523,647 | B2 * | 2/2003 | Duplessis | 187/270 |
| 6,575,685 | B2 * | 6/2003 | Baxter, Sr. | 414/10 |
| 7,815,014 | B2 * | 10/2010 | Preston | 182/82 |
| 2007/0193831 | A1 * | 8/2007 | Vance | 182/141 |

FOREIGN PATENT DOCUMENTS

JP 53067996 A * 6/1978

* cited by examiner

*Primary Examiner* — Alvin Chin Shue
(74) *Attorney, Agent, or Firm* — Ariel S. Bentolila; Werner Schroeder

(57) ABSTRACT

The invention is a hoisting and placement system that also serves as a mobile land based complete crane system that is useful on a building under construction. The crane system can be installed on any floor that has been completed. As the height of the building of the building rises with upper floors that have been completed, the completed crane system can follow the upward work progress by virtue of its own construction. This construction includes a vertical tower mast system that can be attached to completed floors. The crane system can climb up or down on this tower mast system by using various mechanisms to engage one of the masts which form the tower mast system. The tower mast system can support various lengths loading platforms that can move into or out of a building floor.

20 Claims, 21 Drawing Sheets

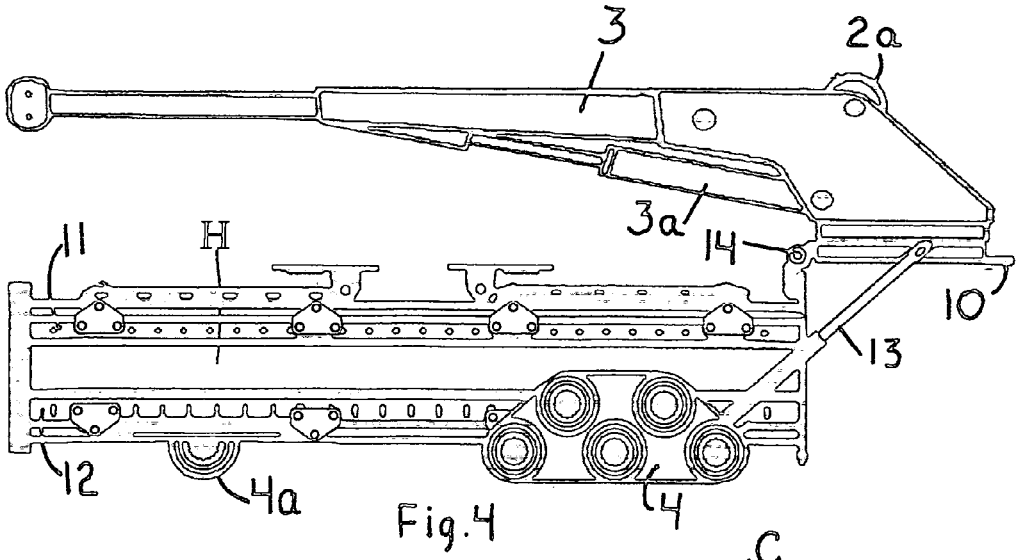
Fig.4
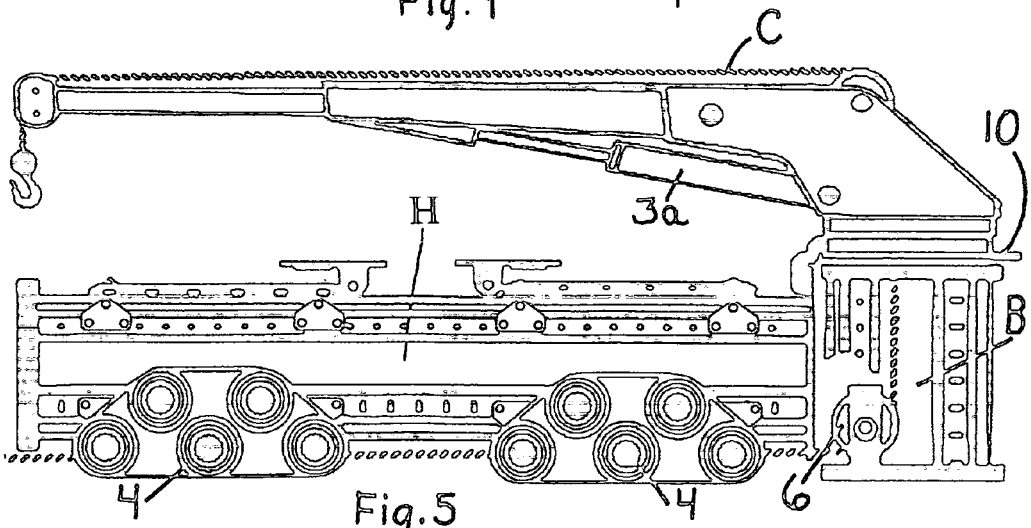
Fig.5
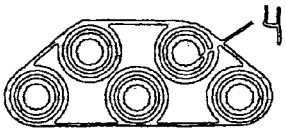
Fig. 5A
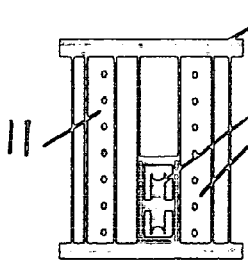
Fig.6A
Fig.6B
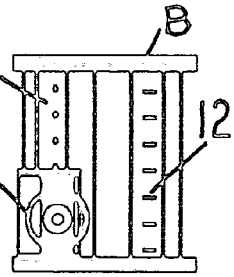
Fig.6

SELF-CLIMBING HOIST, DECK AND SCAFFOLD PLATFORM SYSTEM

This application is a Continuation-in-Part of the Provisional Application No. 61/460,326 filed on Dec. 30, 2010

BACKGROUND OF THE INVENTION

Tower cranes are well known in the construction of high rise buildings. Depending on their size, tower cranes are used in the construction of medium to high rise buildings and the like structures. There generally is high tower standing at the side of the building site and taller than the anticipated site of the building. This tower crane has a long boom with a trolley thereon. The length of the boom must be longer than the proposed width of the building to be able to reach all corners of the building. A shorter end of the boom receives weights to balance the boom with a load at the other end. The weight cannot exceed a certain measure so that the boom stays somewhat balanced without a load and the load to be hoisted cannot exceed a certain measure to avoid overcoming the balancing load on the boom at the shorter end. This a very costly and time consuming operation when constructing a building of great heights.

BRIEF DESCRIPTION OF THE INVENTION

The HOIST, DECK AND PLATFORM SYSTEM invention may be referred to and abbreviated as HDPS.

The Invention is load hoisting and placement system that also serves as a mobile land based crane, jacking, shoring, deck platform apparatus. The inventive crane system is able to independently self climb most buildings or structures as they are being built as well many existing man made or natural structures such as rough stone, metal, smooth glass or wood. The invention can be operated remotely in real time via Internet, radio, cell or land based phones or hard wired or wireless systems. It can also be operated conventionally by lever or button controls. The ability to attach cameras to multiple mechanical arms independently allows for wide, normal and micro views of the overall work area. The invention may be operated from a central station manned by qualified operators. This reduces the need for a large off hour standing cranes often required by building codes for buildings being constructed over 6 floors high.

With optional bolt on power systems and drives, mobile unit can operate freely in tight, narrow or restricted areas because of its ability to be configured in a low and slim profile. In addition, it can expand its footing with extending mechanical arms serving as outriggers with tracks, wheels or pads. Theses robotic/hydraulic arms are able to continuously maintain a level platform base for a boom and/or deck(s) regardless of the surface the unit is supported by. The machine can be advanced from point to point with theses mechanical arms or legs. Additionally, attachments attached to the end of these will have the ability to attach themselves, by drilling, clamping blast charge fastener, screw placement, electromagnetic devices, suction or adhesive application as the main unit is held in position while at least one arm secures a new firm position by one or more of these methods. In turn, one of the other several arms will repeat the process in proper order as the overall unit progresses and advances to its new location.

As a jacking and shoring system, the central structure/mast/beam with its outward leg brace attachments features allows for infinite connecting pints. The leg/brace arms can exert pressure away from or toward any surface it is in contact with. This will serve to adjust, hold, temporarily or permanently any structure such as a wall, floor or platform such as a deck as long as it is required.

Mounted on a truck trailer, the unit can be used to do typical crane work. A special transitional riser with enclosed an enclosed receiver sheave box (used to change various diameter sheaves) will allow the unit to be structurally un-attached from the deck surface and raised by hydraulic or pneumatic cylinders, hoist or crane into a vertical position. This allows the invention to be attached directly to a building, usually the floors. The main vertical center mast structure has within it several shorter adjustable deck clamps. These clamps are able to oppose one another in reverse fashion as hinged plate(s) contact each floor, usually two or more. Any floor thickness is acceptable as well as floor to ceiling heights for additional clamp placement. Once the deck/floor clamps are connected and the extending flanges are bolted to the vertical mast, additional support is obtained by connecting leg braces from the vertical mast to the floors and/or ceilings. This determination is made for each building by the engineer of record. The combined deck clamps and the bracing will have the effect of 'bridging' all floors together so that dynamic load forces of hoisting loads are distributed over all floors rather than one floor.

A small re-positioned hoist can easily be moved from floor to floor for lifting the fully operating or partial units up or down. Once in position, a self contained manual, electric, pneumatic or hydraulic operating crane can be attached to the top transitional cap system. The design of the invention's boom base has two hinged plate designs that have the ability to maintain a level or predetermined angle because of two or more hydraulic cylinders and/or wedge shaped fixed spacers placed between the lower and upper cap sections. This transition sections allows the wire rope/boom to function from horizontal through vertical positions without interruptions. One element of this new design provides the customer with several performance choices as far as speed, capacity and cost are concerned while still keeping the overall design small and very competitive. Where as a typical crane is very large, heavy and expensive often weighing hundreds of tons, this inventive concept has the ability to move much of the same material sized loads that standard sized cranes do. This invention uses the building's existing mass and stability for support and because of this, does not require very much weight itself. Therefore, the need for a ground boom with counter weights is not required to lift loads hundreds of feet high. Additionally, the central mast and center sliding internal clamps all have a hole at their center that allows the hoists/cranes wire rope or cable to pass directly through from one end to the other of the vertical mast, transition cap and over the boom point sheave to the ground. This allows the power system, hoist and related components to remain at ground level where they can be serviced, fueled or swapped out for larger performing systems as the building goes higher into the sky as it is being built.

The invention has the ability to pace the boom anywhere from the ground to beyond the top floor of the building and even build new floors. When loads need to be placed into the building interior from the open side of the building, outrigger platforms are typically being used. They are usually rigid fixed platforms cantilevered beyond the floor edge and they are held in position by standard post shore jacks placed between the floors and ceilings. A crane is required to move them on and around the building.

When theses units are used, they have to be staggered so as not to interfere with load placements on lower floors by obstructing the crane's wire rope or cable. When movable platform transfer decks are used, several units are often required or desired. They operate much like a 'chest of drawers'. Most often, they protrude some distance outwardly from the building and present an obstacle as loads are lifted past them to higher floors.

To eliminate these issues, part of this new system includes a drop down deck that can fold up or down against the building front so that loads can quickly pass by without slowing down at every floor without hitting them.

Another design will show how a system of one or more split ring collars fastened to the vertical mast column will allow a fully rotational deck to be attached. The deck can be partial in shape such as a pie section, half circle or full 360 degrees circle in circumference to allow loads to be supported on it. They can work on or around the column, exterior or interior of the building or structure as required. A 180 degree deck/platform will allow for total load clearance once it is positioned inside the building away from passing loads.

It should be noted that the jack leg braces are in position and the screw/turnbuckle design feature can exert great pressure on the deck floor and ceiling from the top and bottom. This clamping effect can eliminate the need for hole placements in the building structure in many cases as determined by the Engineer of Record.

The system can be used as a suspended deck supported by one vertical mast that can be raised or lowered as neede4d. This deck(s) can be equipped with handrails for use by personal to work within confined area for safety. When required, additional vertical masts can be positioned parallel in a series along one full side of a building, a corner section or the full perimeter of a structure and connected together by their deck (s)/platform(s) and operated as one long continuous deck system. These combined units are able to be raised or lowered as a whole or staggered 'in stair step' manner. This eliminates any support having to originate from the ground level on a high building structure. Being that the vertical mast(s) have the ability to move diagonally across a wall type surface, the attached deck/platform systems are able to remain level to the ground for workers to work from.

BRIEF DESCRIPTION OF THE DRAWINGS

FIG. 4 illustrates a self-centering wheel in conjunction with two tracks;

FIG. 5 shows a winch box below a crane platform;

FIG. 5A illustrates all terrain wheels;

FIGS. 6, 6A and 6B illustrate various views of the winch box including sheaves located therein;

FIG. 20 is the top view of the cage system of FIG. 19;

FIGS. 41 and 42 illustrate the trolley of FIGS. 40 and 41 with a forwardly extending personal cage;

DETAILED DESCRIPTION OF THE INVENTION

Figure 1:
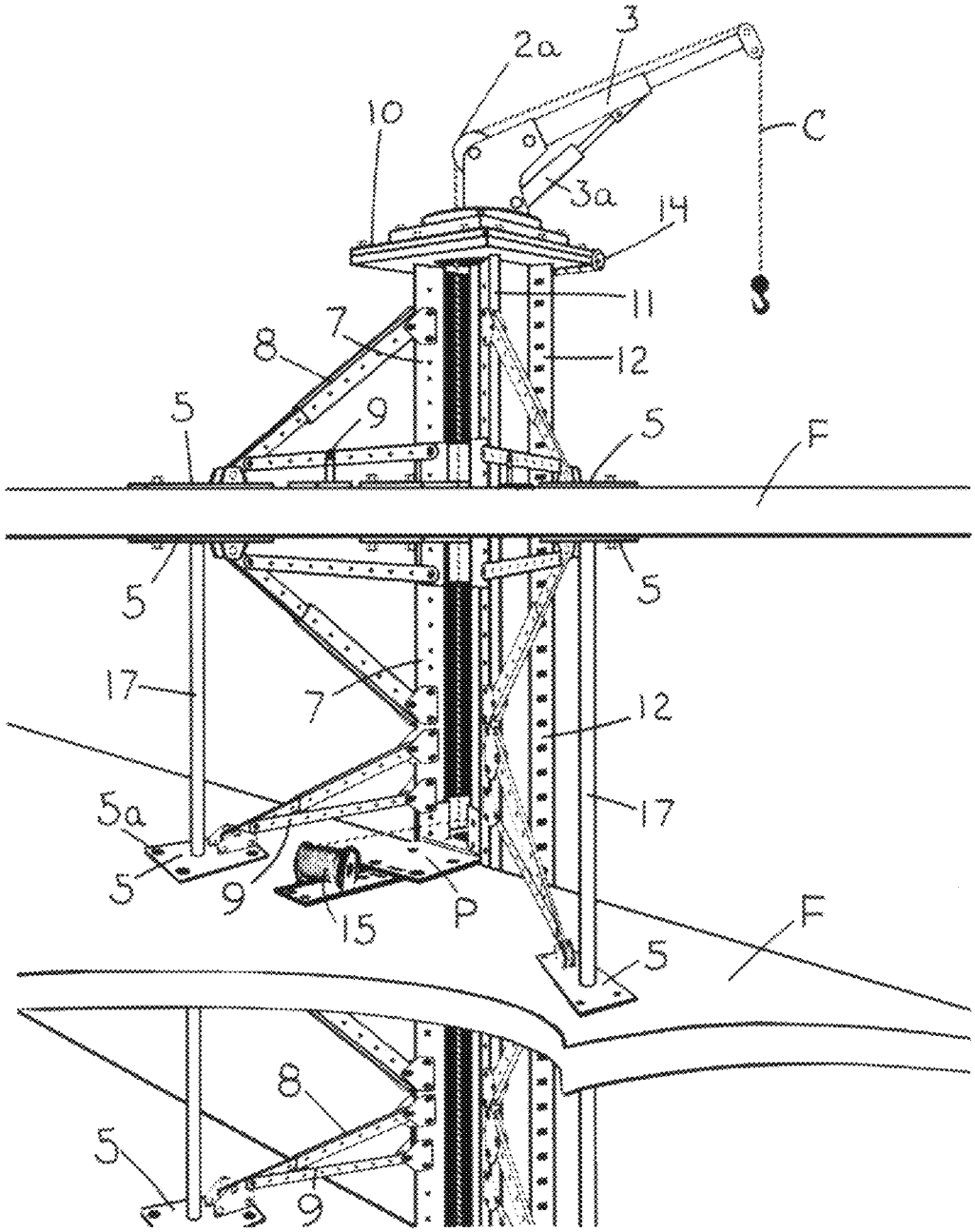
FIG. 1 illustrates the overall installation of the self-movable hoist system.

FIG. 1 illustrates an assembled hoist system on a building having the floors F with the inventive crane system installed thereon. The crane device 3 is installed on a transitional cap system 10. The crane 3 is operated in its up and down positions by a hydraulic or pneumatic piston 3*a* and shows a cable C which is trained over the sheave 2*a* which trained own through the middle of the mast assembly 12. The mast assembly includes a main vertical mast 7 which is stabilized in lateral attitudes by diagonal braces 8 and 9 which are attached to floor mounted deck clamp plates which are fastened to the floor F by way fasteners 5*a*. There is floor F platform P mounted on the floor F which platform has a winch 15 mounted thereon which operates the cable C through the center of the mast assembly 7 and 12. The plates 5 on the floor F and at the ceiling are also held in place by way of post shore jacks 17.

The boom shown in FIG. 1 is fully functional in that it can boom up, down extend outward or inward and rotate 360 degrees left or right. The boom can be of any type that can be attached to a base. The inventive boom has a sheave/wire rope positioned so that is centered in the holes or openings as it passes through the vertical mast.

Figure 2:
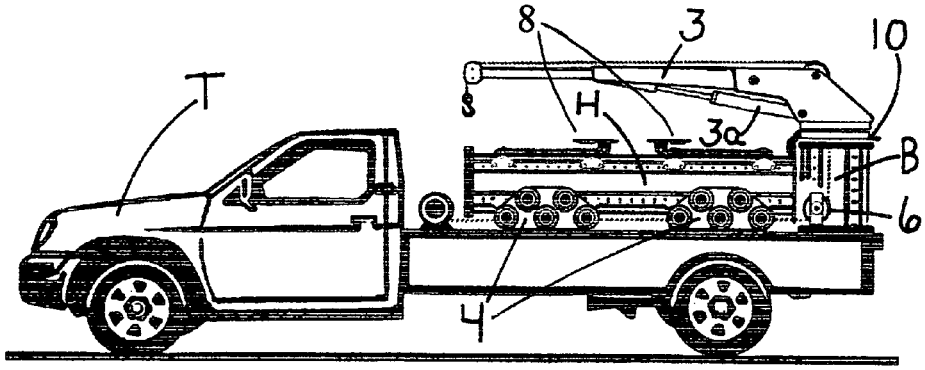
FIG. 2 Illustrates the hoist system with all terrain wheels located on a truck.
Figure 3:
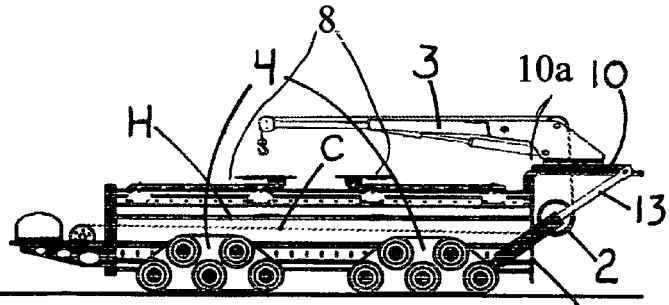
FIG. 3 shows the hoist system of FIG. 2 after unloading.

FIG. 2 illustrates a truck T that carries all the necessary elements to a building site. The crane assembly is supported by a modified I- or -H beam(s) or other supporting structural member such as a round, square or rectangular or specially extruded or hollow formed tube which has a multiple of wheels 4 which will adapt themselves to any terrain on which the crane assembly is transported. At one end of the I-Beam, or the above described member, there is located a box enclosure B which has a sheave 6 located thereon for the purpose of diverting the cable C running from the winch/hoist 6*a* located on the truck T. The enclosure B has located thereon the transitional cap system 10 which is shown in FIG. 1 on top of the mast. As is shown in FIG. 1, FIG. 2 and FIG. 3 The crane 3 is mounted and supported on the transitional cap system 10. FIG. 2 also shows the leg braces 8 (FIG. 1) placed on top of the I-beam which are placed on top of the of the above described structural members or I-Beam.

Figure 2A:
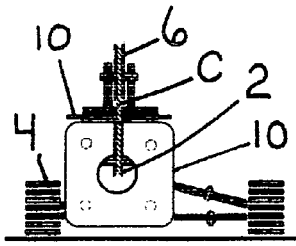
FIG. 2A illustrates a rear view of the basic crane assembly after having been unloaded from truck.

FIG. 2A illustrates a rear view the basic crane assembly on a ground. The sheave 2 can be seen guiding the Cable C on its way to the crane by way of the sheave 6 which is located in the enclosure B (FIG. 2).

FIG. 3 is a side view of the basic crane assembly positioned on the ground with its all terrain wheels 4. In this view the transitional cap 10 is hinged at 10*a* and is operated in a rotational movement by the hydraulic or pneumatic cylinder 13. The I-beam P has at its end a sheave 2 to properly guide the cable C on its way to the crane 3. Again the leg braces 8 are shown on top of the I-beam P.

FIG. 4 shows the basic crane assembly on top of all terrain wheels 4 having a self-centering wheel 4*a* in conjunction with two wheel tracks 4. All of the call outs have been explained with FIGS. 2 and 3.

FIG. 5 is a more detailed view of FIG. 4 except that both wheel tracks are still mounted on the basic mast P. At the right end of the Mast P is shown the box enclosure b having the transitional platform 10 mounted thereon including the sheave 6 which properly guides the Cable C to the crane 3. The attitude of the crane 3 is controlled by a hydraulic or pneumatic cylinder 3*a*. This Fig. also shows the importance of a hollow boom having a sheave 6 at its bottom to pass the cable C there through to the top of the boom (shown in later Figs.) where the crane 3 is located on top of the transitional platform 10.

FIG. 5A shows the wheel tracks 4 by itself.

FIG. 6 illustrates the box enclosure B in a side view. The box enclosure B consists of the mast elements 11 and 12 which form the basic elements of the overall mast structure 7 which will be further explained below. Also shown is the sheave 6.

FIG. 6A is rear view of the box enclosure B.

FIG. 6B shows the sheave 6 by itself removed from the box enclosure B.

Figure 7:
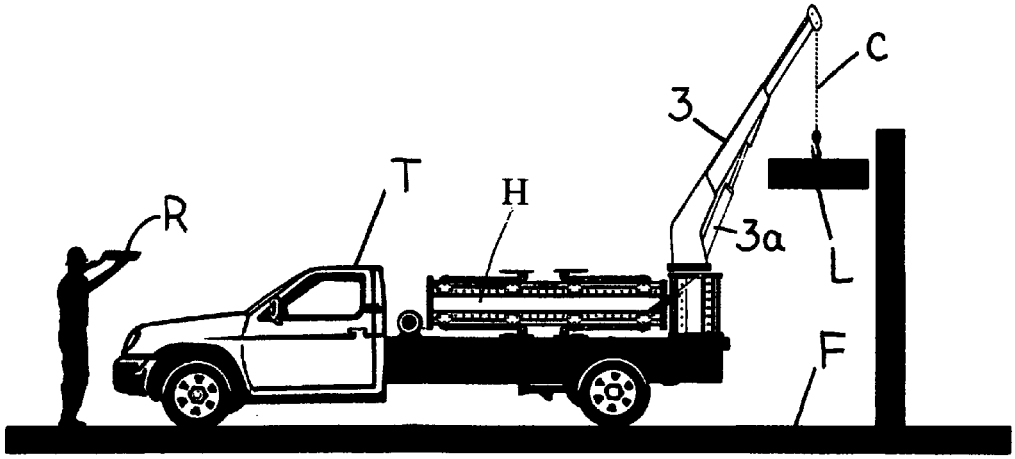
FIG. 7 shows the crane independent from a building while loading onto the building.

FIG. 7 illustrates the crane assembly still mounted on the truck T on the ground G being able to hoist a load L to a higher level which is independent of any other use of loading equipment. The crane boom 3 is adjusted to different attitudes by way of the power cylinder 3. Also notice that movement of the various elements is controlled by an operator using a remote control R.

Figure 8:
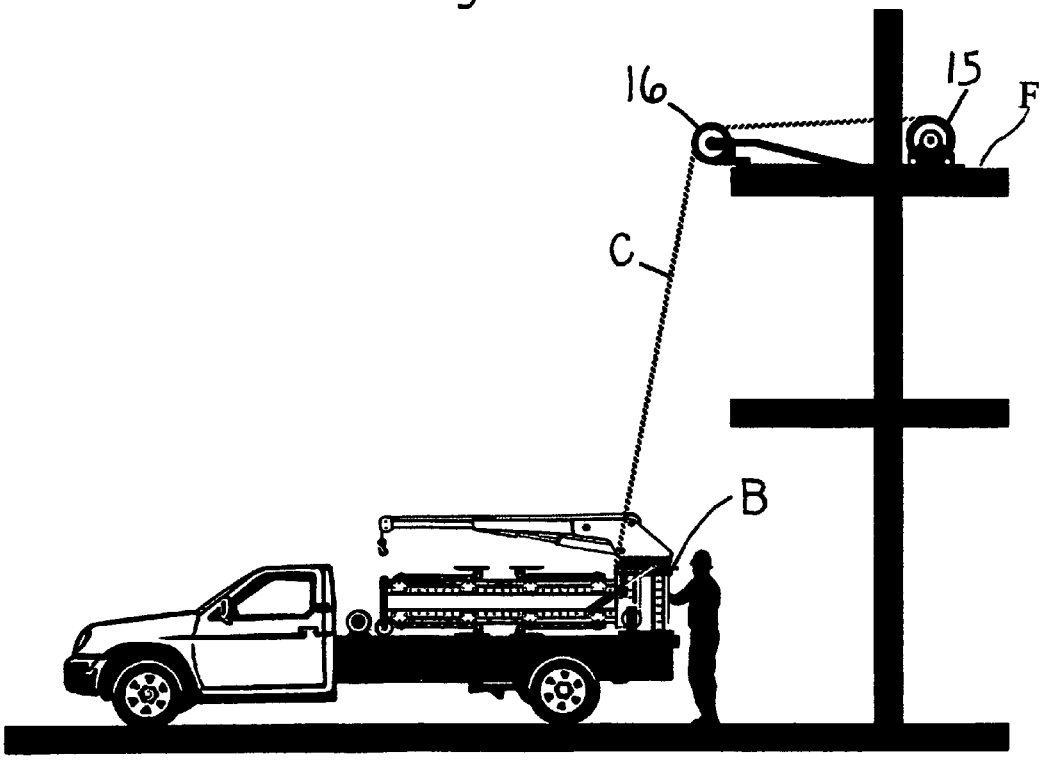
FIG. 8 shows a winch placed on an upper floor and operated by a person on the basic truck.

FIG. 8 shows a load such a platform having a winch 15 and a sheave 16 thereon having previously been placed on the floor F by the independent crane assembly shown in FIG. 7.

Figure 9:
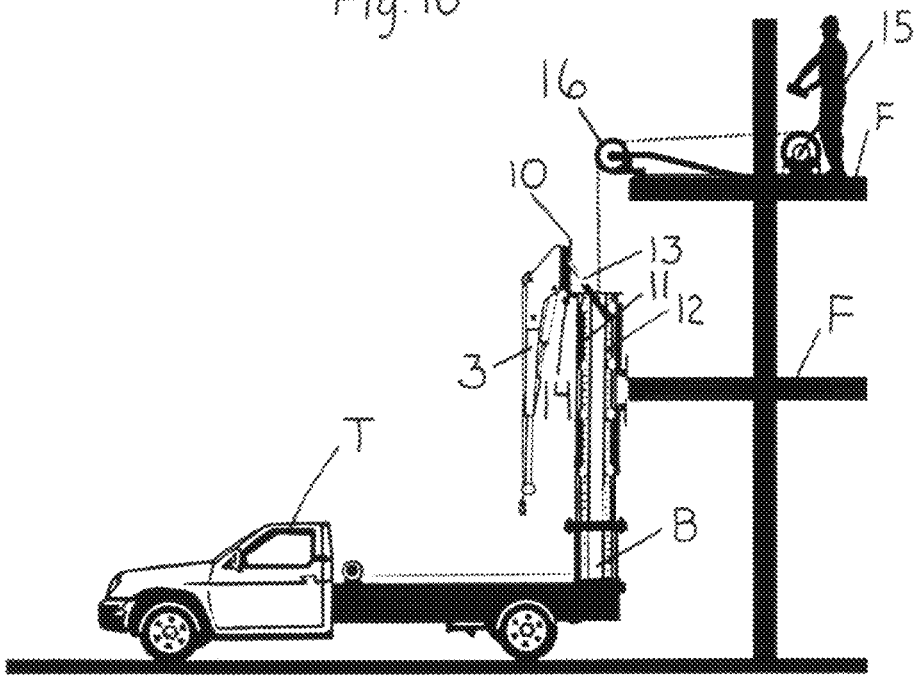
FIG. 9 shows the winch of FIG. 8 about to lift the crane assembly from the truck.

FIG. 9 now shows how the winch 15 is now used to hoist the basic crane assembly 3 from the truck T after the crane assembly has been disconnected from the truck. The building structure consists of several floors F and floor may be chosen where the basic crane assembly 3 should be installed. The basic crane assembly 3 has the transitional cap system 10 attached to the mast consisting of elements 11 and 12. The cap 10 is hinged to the cap 10 by a horizontal hinge 14 and is operated into different positions by the power cylinder 13.

Figure 10:
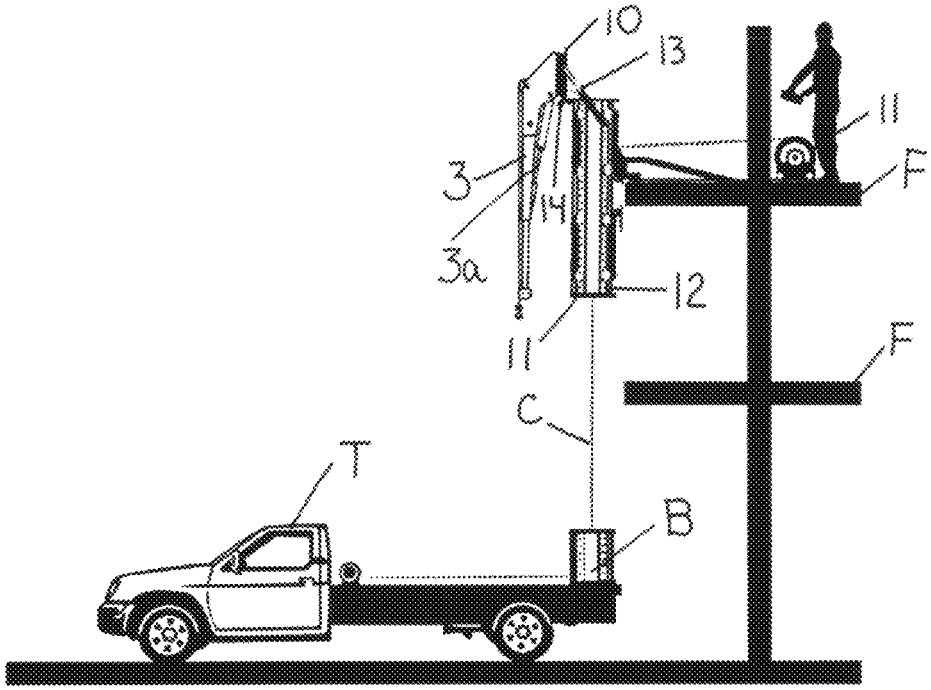
FIG. 10 shows the crane of FIG. 9 about to be received on an upper floor of a building.

FIG. 10 illustrates the same view as FIG. 9 except that the crane assembly 3 has now arrived at a predetermined floor F. and is ready to be installed thereon.

Figure 11:
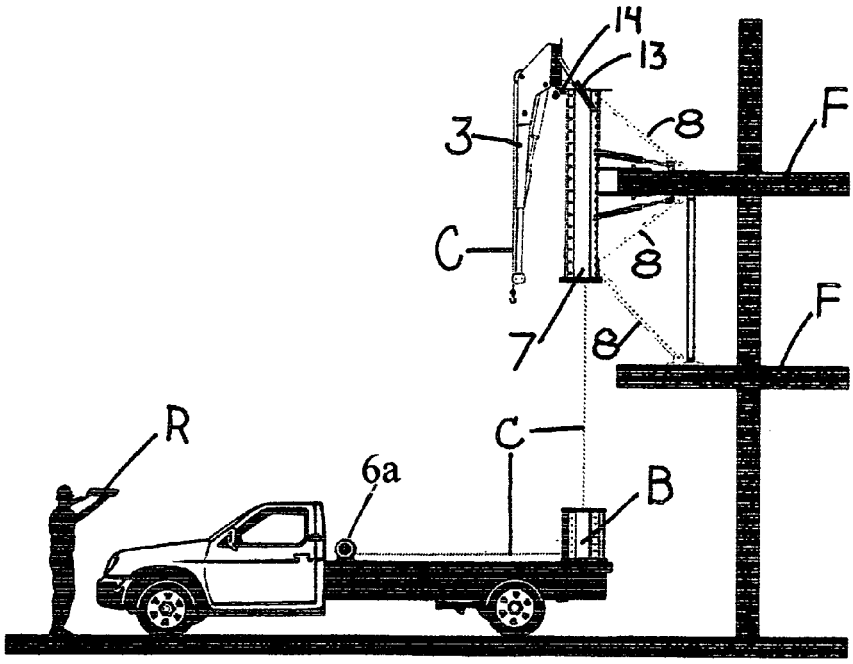
FIG. 11 shows the crane of FIG. 10 after having been installed on an upper floor.

FIG. 11 illustrates the progression of the installation of the crane assembly 3 by installing various braces to stabilize the overall crane assembly. The diagonal braces shown in FIG. 1 at 7 are now installed above and below the floor F. Also the post shore jacks are used to strengthen the installation between the two floors F.

Figure 12:
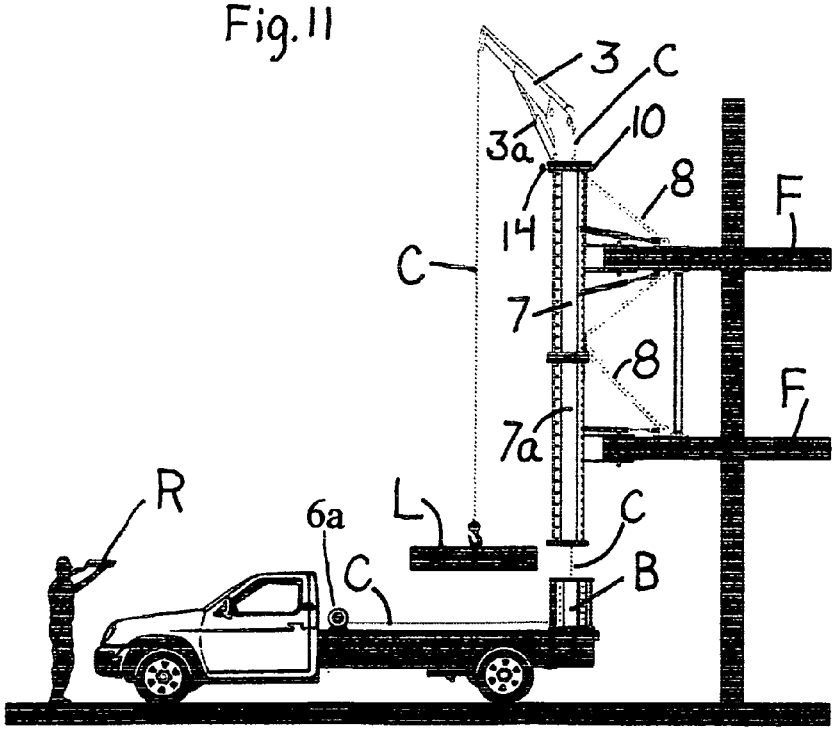
FIG. 12 shows the crane of FIG. 11 operating from the truck while lifting a load.

FIG. 12 illustrates the further construction of the basic crane assembly 3 there by adding various extensions to the mast structure 7 (FIG. 1) which consists of the various elements or components 11 and 12 which will form a hollow structure possibly of a square configuration. In FIG. 12, there is an upper mast structure 7 which is being extended to a greater length by adding another mast structure 7*a* to its lower end. After the lower mast structure 7*a* has been added, a load L can be hoisted by the winch 6*a* and the truck by guiding the cable C through the box enclosure B, through the center of the mast assembly 7 and 7*a* and further through the crane 3 located on top of the transitional cap assembly 10 (FIG. 1). The load L can be hoisted to different floor levels as will described below.

Figure 13:
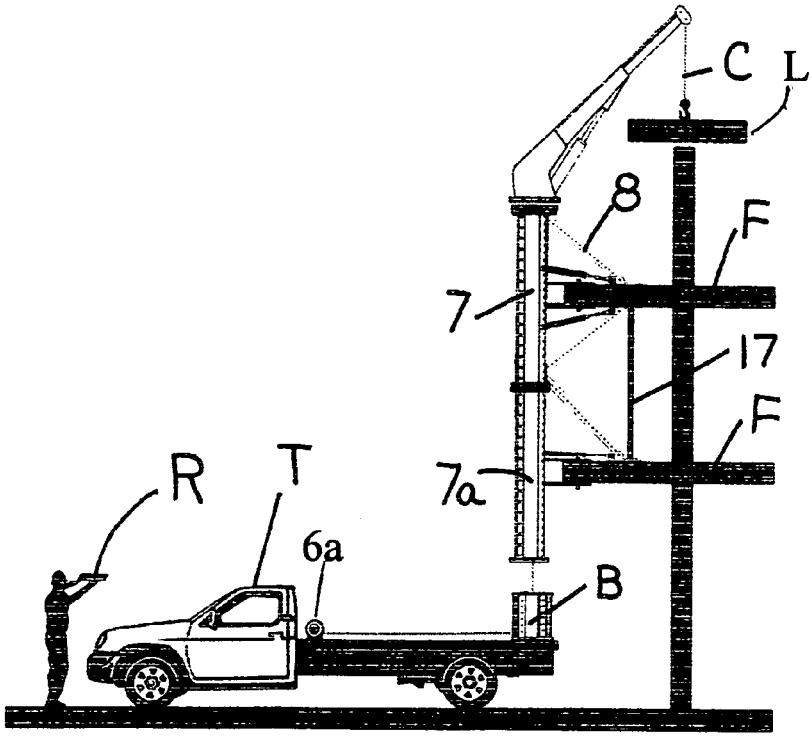
FIG. 13 shows the crane of FIG. 12 operating from a truck and lifting a load to an upper floor.

FIG. 13 illustrates how a load L may be hoisted to different floor levels which is hoisted by a cable coming from a winch 6*a* on the truck L.

Figure 14:
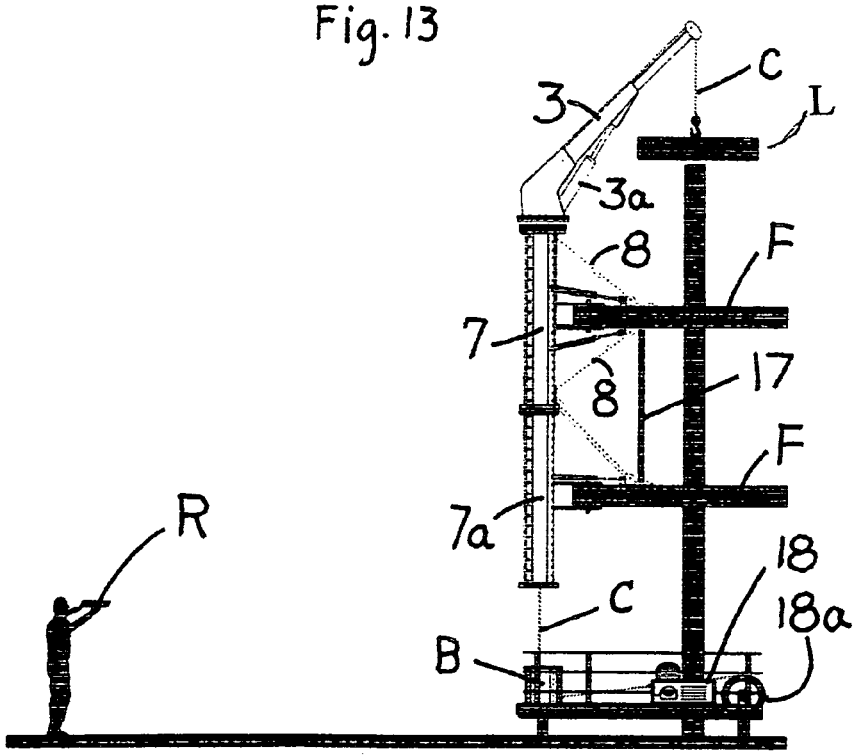
FIG. 14 shows a building deck with a vertical mast on the front of a building floor.

FIG. 14 shows the same operation and hoisting a load L as was shown in FIG. 13 except that an independent power system has been placed on the ground to thereby dispense of the truck L. The power system 18 has a winch 18*a* thereon which powers the cable C running through the box enclosure B and up through the center of the mast assembly 7 and 7*a*.

Figure 15:
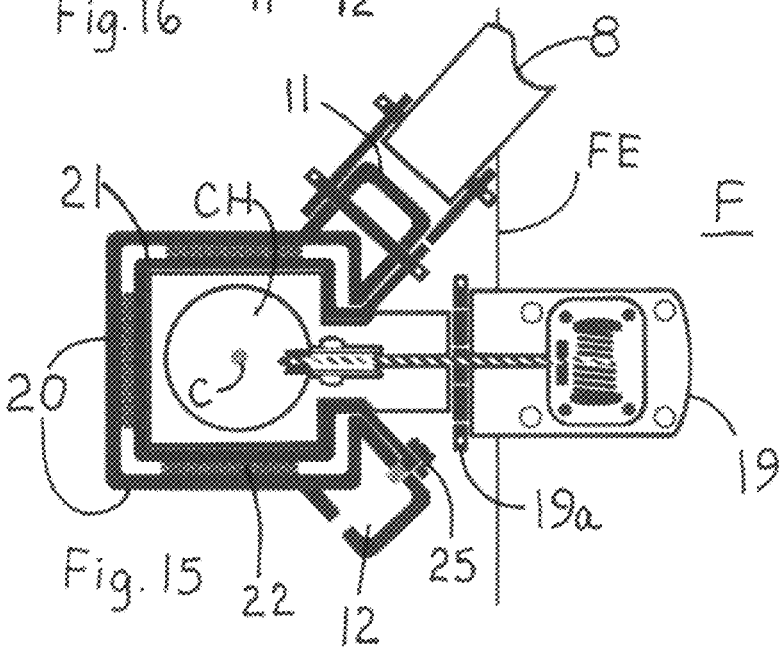
FIG. 15 illustrates a plan view of a cross section of the mast and inner deck clamp.

FIG. 15. This a plan view to show a cross section of the vertical mast and the inner deck clamp 19 with a hinged deck plate in a lowered and connected position to the building floor F. The front of the building floor F is designated as FE. The connecting bolts 25 are connecting the center deck clamp 19 to the inward vertical mast element 12. The main hollow mast shows outer walls 20 and contains an inner sliding deck clamp having a center hole CH for containing the cable C therein and the sliding deck clamp 21 has friction material 22 between the inside wall of the hollow and itself. As will be shown below, the deck clamp 19 has a forward horizontal hinge element 19*a*.

Figure 16:
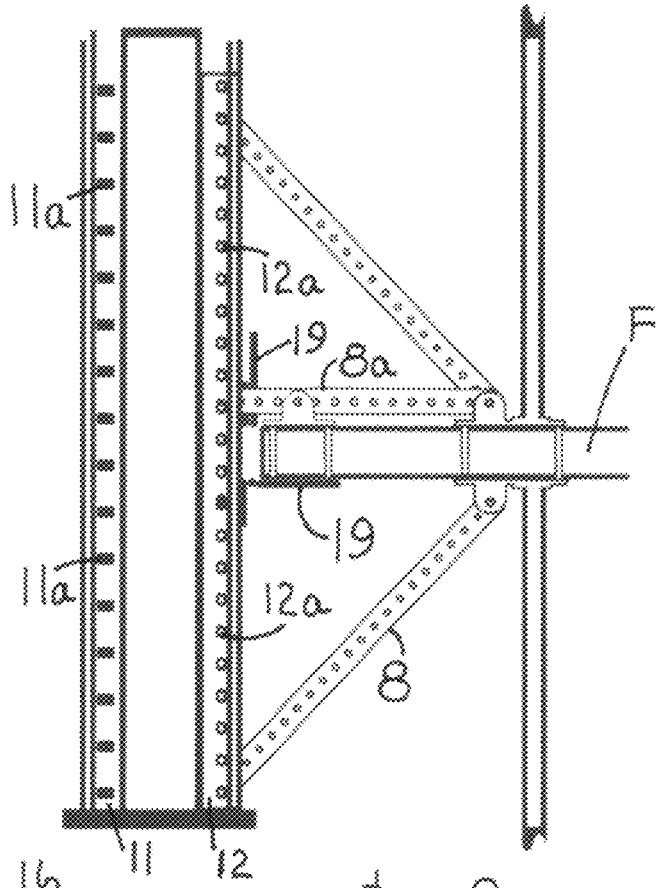
FIG. 16 shows the addition of an independent hoist boom with point sheave attachment.

FIG. 16 shows a building deck or floor F with a vertical mast on its left side. The far outer extension or vertical mast element 11 has rectangular holes 11*a* for attachments or the use by gear wheels which be explained below. The other vertical mast element 12*a* has holes that allow leg braces to be attached as needed.

Figure 17:
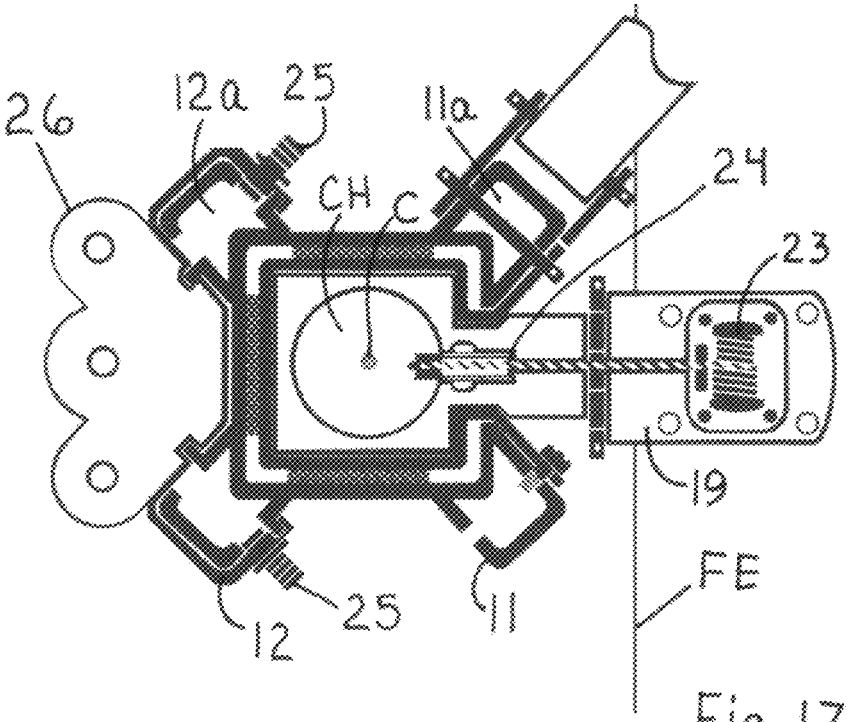
FIG. 17 is a plan view of an attachment plate including a winch.

FIG. 17 is a plan view showing an attachment 26 that will fit perfectly over the outer two vertical extensions 12 and 12*a*. This allows for an independent lifting or lowering by the existing or internal hoist. It can also be self-powered with its own power/motor direct gear drive system (to be explained below) that will allow it to move as needed up or down to any given point. Also this FIG. 17 shows its own winch assembly 23 which is mounted on the deck clamp plate 19 Just inside from the floor edge FE.

Figure 18:
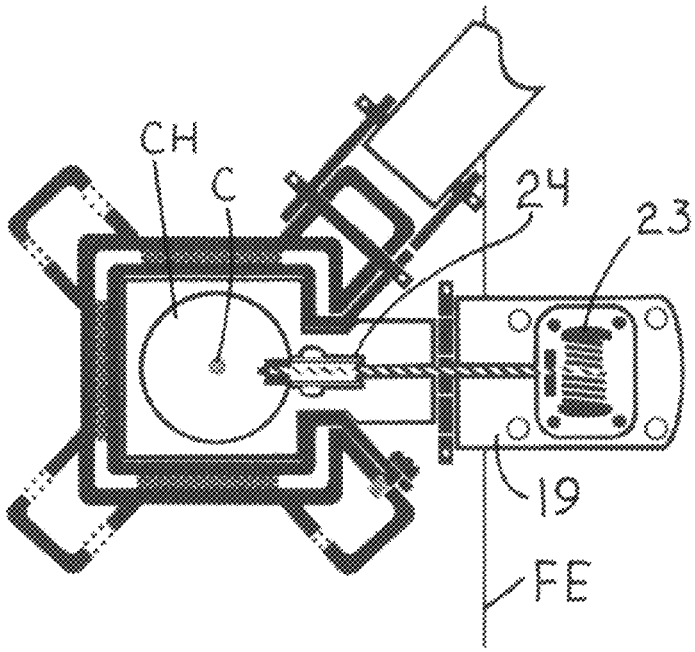
FIG. 18 is a plan view of an of an addition that allows for the independent raising or lowering the crane assembly from the truck on the ground.

FIG. 18 shows the addition of the of the independent small boom with a sheave 24 mounted thereon that is used by way of the cable C for independently raising or lowering the inventive crane assembly from the Truck on the ground onto the building and on to higher floors. The sheave 24 directs the cable C through the center opening in the main boom and on to an attachment point of the main vertical mast, usually at the base. In this Fig. notice the front edge FE of the floor F. The deck plate clamp is shown at 19 which has the winch 23 mounted thereon.

Figure 19:
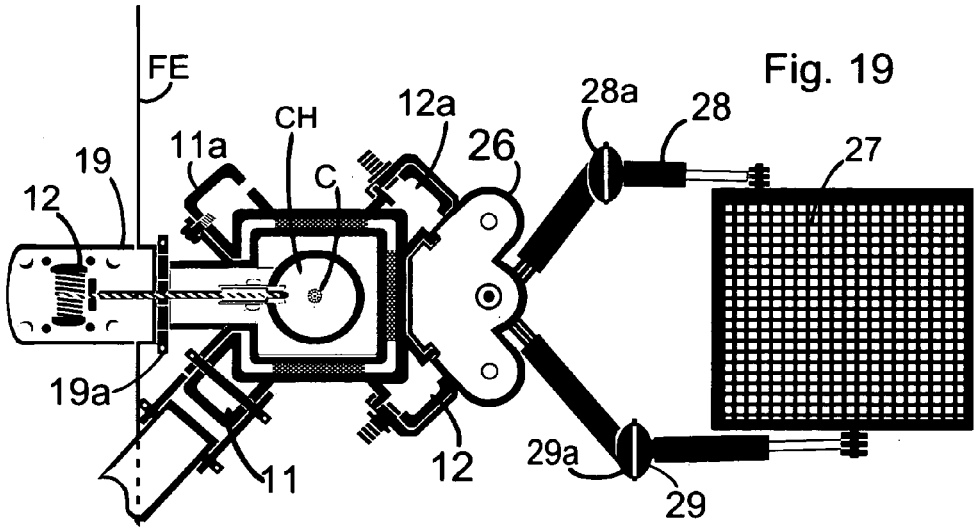
FIG. 19 shows is a side view of a personal cage system that is being held in position by mechanical arms.

FIG. 19 is a plan view of a personal cage system which is being held in position by at least two mechanical arms 28 and 29 which are being hinged 28*a* and 29*a* and are further connected at their other ends to the attachment plate 26. The mechanical arms 28 and 29 have full rotational and extension or retraction ability at all connecting points giving them a complete range of motion as needed. All other reference call outs have been shown in FIGS. 17 and 18.

Figure 20:
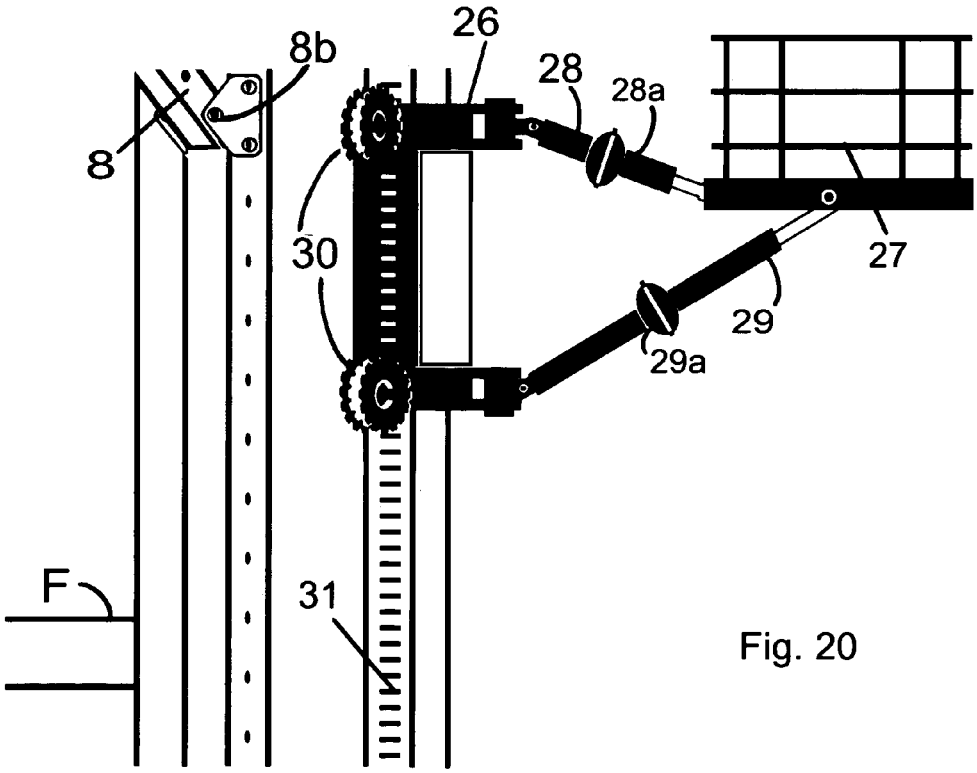
FIG. 20 shows a side view of a personnel cage system that is being held in position by mechanical arms

FIG. 20 is a side elevation view of FIG. 19 showing the personal cage 27 with its mechanical arms being connected to the attachment plate 26. This platform system 27 can be moved up or down on one of the vertical masts by a dual wheel drive 30. Also shown in this Fig. are the extending brace arms 8 and the connecting flanges 8*b*.

Figure 22:
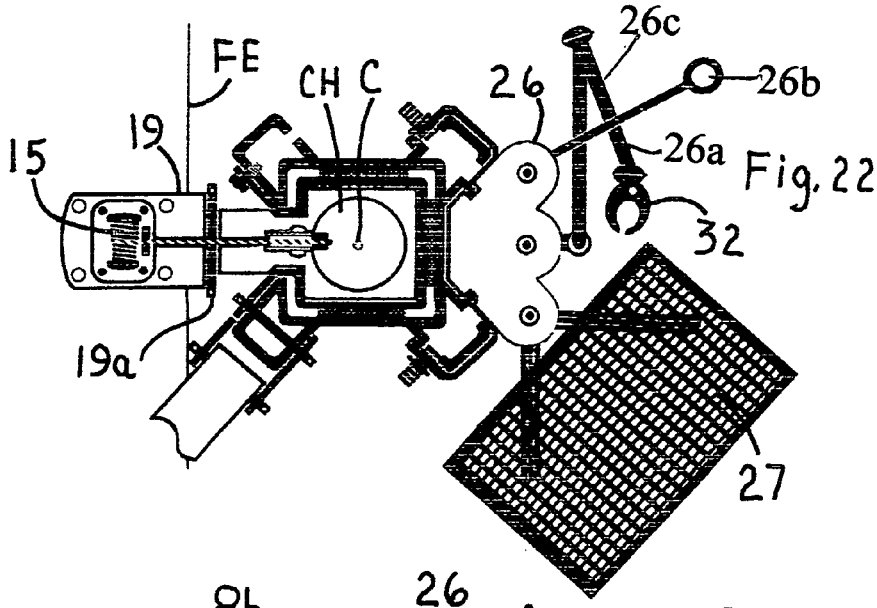
FIG. 22 is a plan view of the system of FIG. 21 showing the cage moved into a different rotational position.
Figure 21:
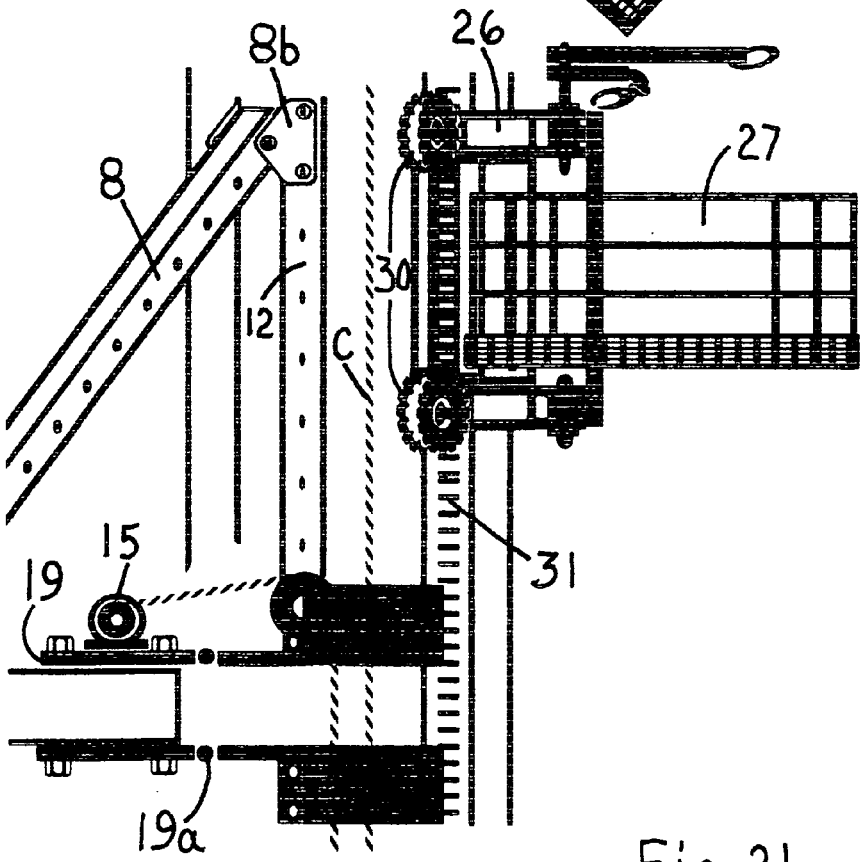
FIG. 21 illustrates an example of a gear drive that moves the cage up or down.

FIG. 21 is a vertical side view of the personal cage system with its dual gear drive system. The personal cage is shown in a rotational position. The attachment plate 26 has on arm 26*a* attached to it is a receiver hook 26*b* for making mid-air load exchanges. Another arm 26*c* is attached to the attachment plate 26 and is fitted with a claw type holding attachment 32. This Fig. also shows the dual wheel assembly which is riding on a vertical mast which has elongated slots therein which serve as the counterpart of the gear wheel assembly. The whole assembly of FIG. 21 is supported by the deck plate clamp 19 which has a horizontal hinge 19*a* just forward of the floor edge FE FIG. 22 is a top plan view of the side view of FIG. 21. It is noted that the personal platform is placed in a rotational position relative to the attachment plate 26. At the opposite end of the attachment plate 26 is located the deck plate clamp 19 which ahs the horizontal hinge 19*a* mounted thereon extension which is hinged to the attachment plate 26 by way of the horizontal hinge 19*a*. This deck plate clamp has mounted thereon a winch 15 which trains its cable C over the sheave 24 into the hollow mast assembly through its center.

FIGS. 23-26 illustrate how various attachments can be mounted onto a vertical mast.

Figure 23:
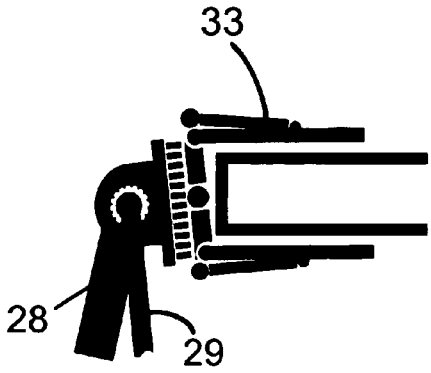

FIG. 23 is an all position clamping device for the mechanical arms 28 and 29 which are attached to the clamping device by way of an electro magnetic device.

Figure 24:
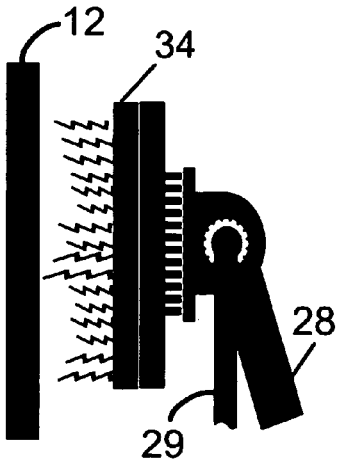

FIG. 24 is designed for an electro-magnetic to a an iron or steel surface. Again this mode of attachment has the mechanical arms 28 and 29 attached thereto for purposes described above.

Figure 25:
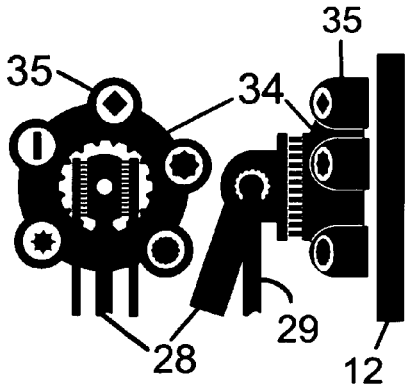

FIG. 25 illustrates a multi-rotational unit which again is attached to iron or steel components by of an electro-magnetic force. The mechanical arms 28 and 29 are attached to a plate 35 which consists of a rotational arrangement whereby the mechanical arms can be oriented into various positions. The plate 35 may attached to a vertical mast by of the electro-magnetic device 34. The multi-rotational unit, once installed, allows for a placement And use of specialized drills, screw drives, impact devices, blast change fasteners and adhesive dispensing etc.

Figure 26:
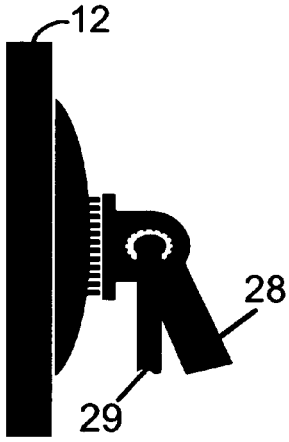
FIGS. 23-26 illustrates various ways of attaching mechanical arms to the mast assembly.

FIG. 26 illustrates a suction cup device for a smooth surface attachment and, of course, dis-attachment.

Figure 27:
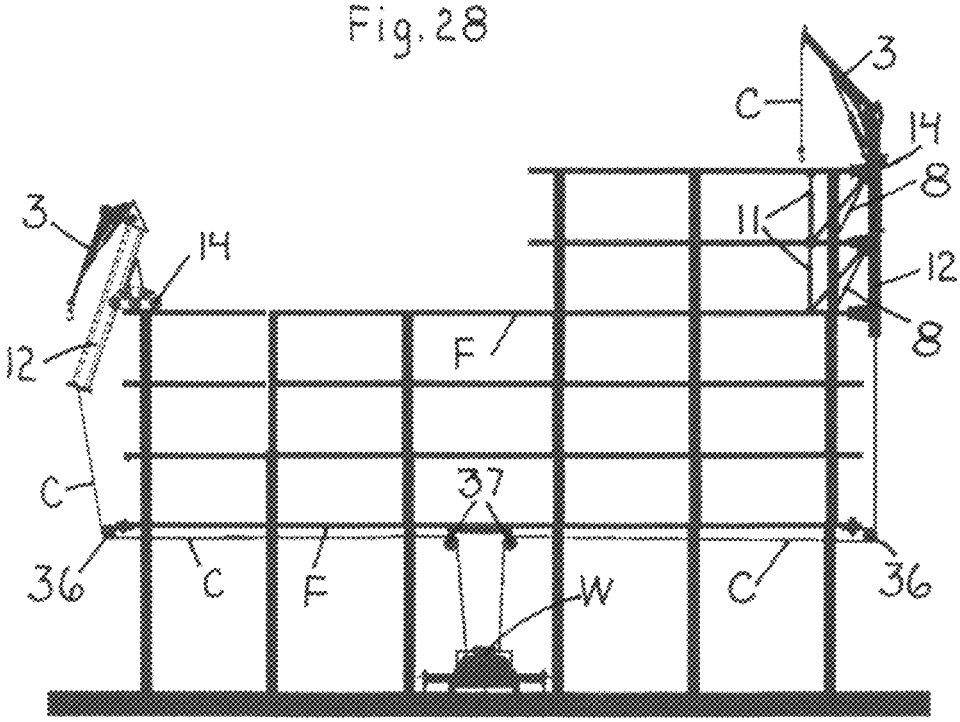

FIG. 27 illustrates the inventive concept applied and configured on a typical building. This Fig. shows an option for allowing the inventive unit to make a transition from the vertical to horizontal by using the pivotal action of the track attachment. The hinged cap attachment 14 with the connected hydraulic or pneumatic piston 13 (FIGS. 9 and 10) assists in orienting the crane 3 into different positions as is required during a movement. In this Fig. there is provided a central ground based power device consisting of two winches W which can service both left and right cranes 3. The cables C are trained over two sheaves 37 under the floor F to further sheaves 36 and around the same to both left and right cranes 3. Both cranes 3 consists of vertical booms 12 and diagonal braces 8 (see FIG. 16, for example).

Figure 28:
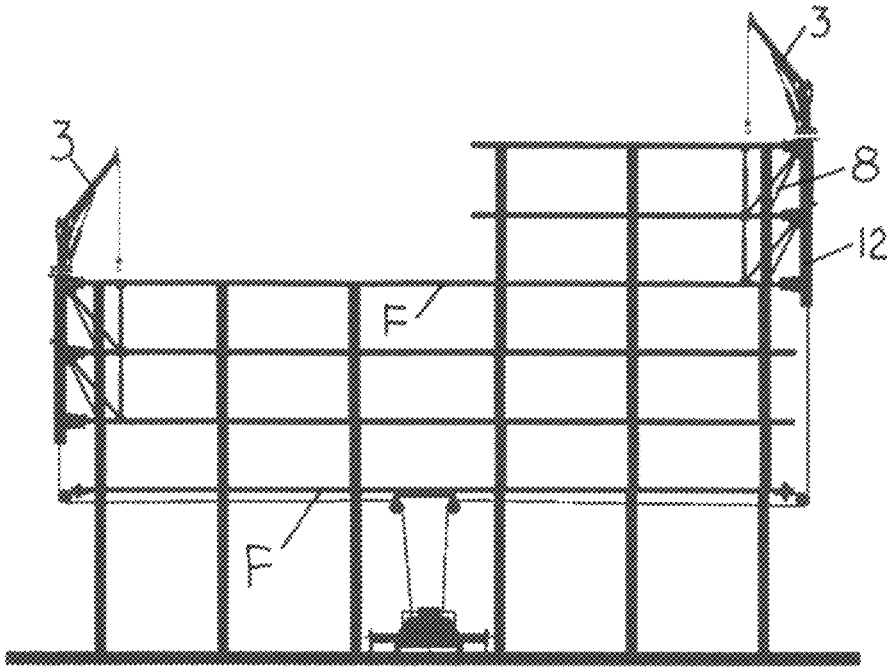
FIGS. 27 and 28 illustrate the crane assemblies configured on a typical building.

FIG. 28. shows the concept of FIG. 27 where the left crane 3 is in a pivotal movement but in this FIG. 28 the crane is in position and ready to be used.

Figure 29:
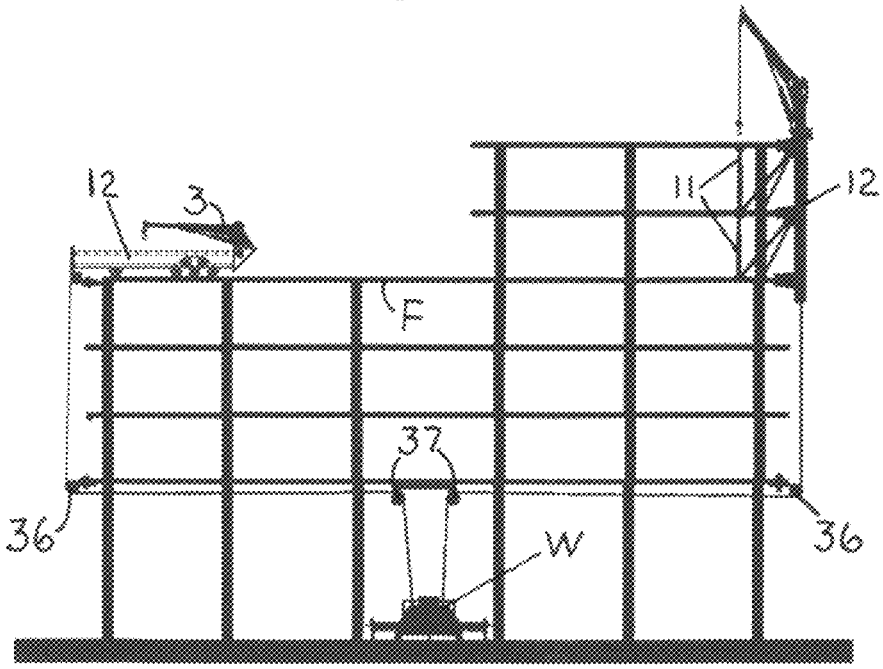

FIG. 29 shows the crane in a horizontal position after undergoing the pivotal movement described in 27. This crane assembly can be transported on the floor F by way of the wheels 4 (see FIGS. 4 and 5) to different locations as required. Such a crane assembly 3 can be moved to the opposite side of the building to be installed there.

Figure 30:
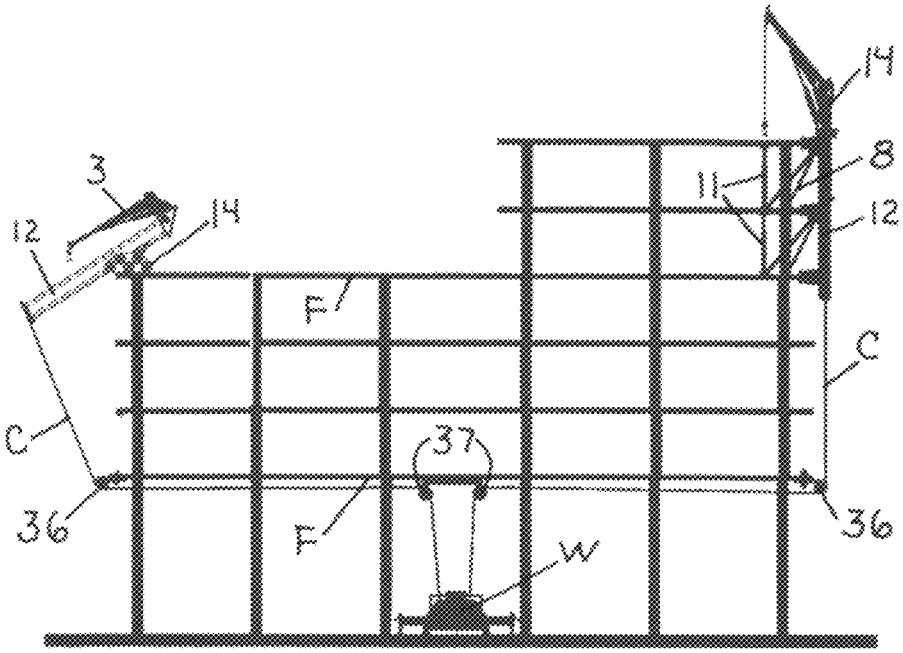
FIGS. 29 and 30 illustrate still other ways of attaching cranes to various buildings.

FIG. 30 shows the same view as shown in FIG. 7 except that the crane assembly 3 has continued in its pivotal movement to further illustrate the capability of the inventive concept of a self-climbing hoist.

Figure 31:
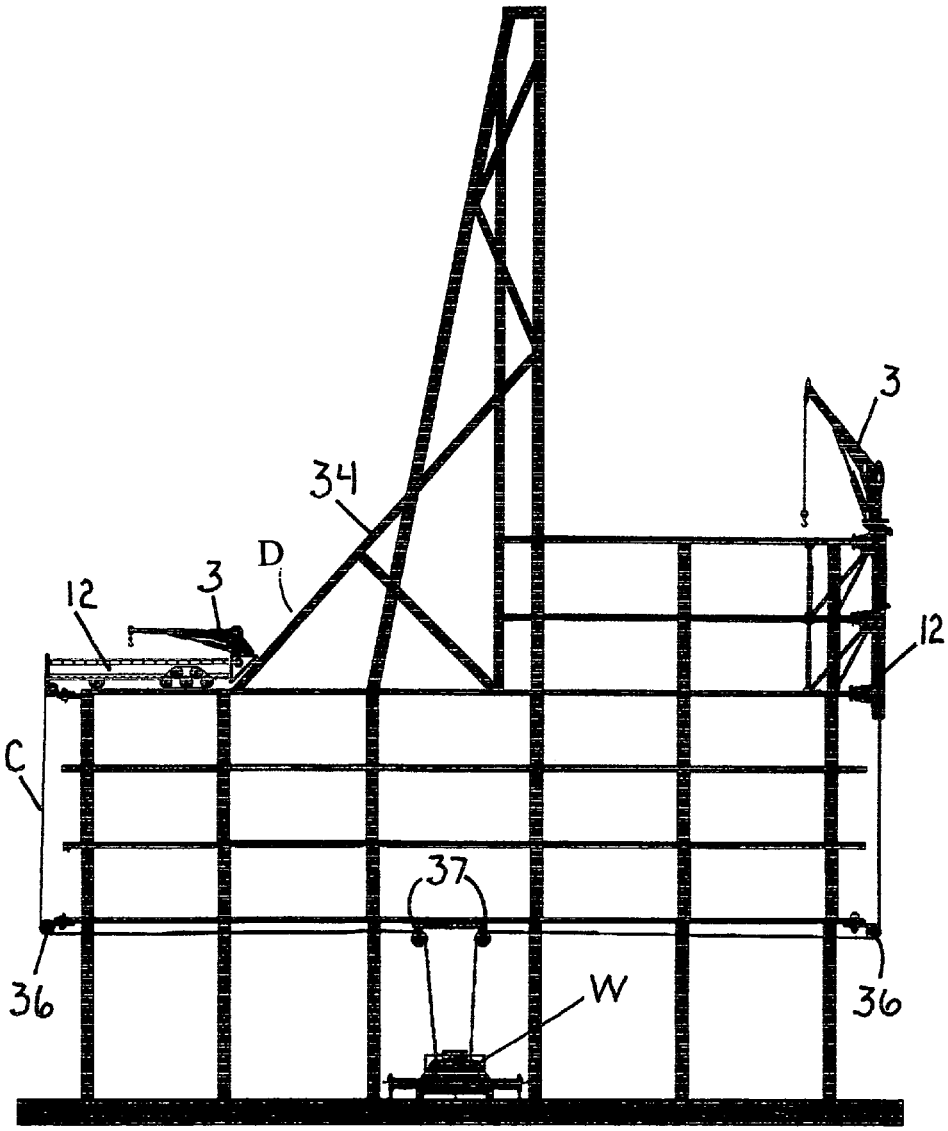
FIGS. 31 and 32 shows the movement of the crane assembly from one building type to another adjacent type building.

FIG. 31 Shows the capability of the inventive crane assembly fitted with one option for allowing the until to make a transition from a vertical position to a horizontal position by using the pivoting action of the track attachment. This arrangement is quite valuable when encountering different building construction as shown by a diagonal brace D where the unit would encounter another building structure. The same reference numbers are placed in this Fig. as can be found in FIGS. 27 and 28.

Figure 32:
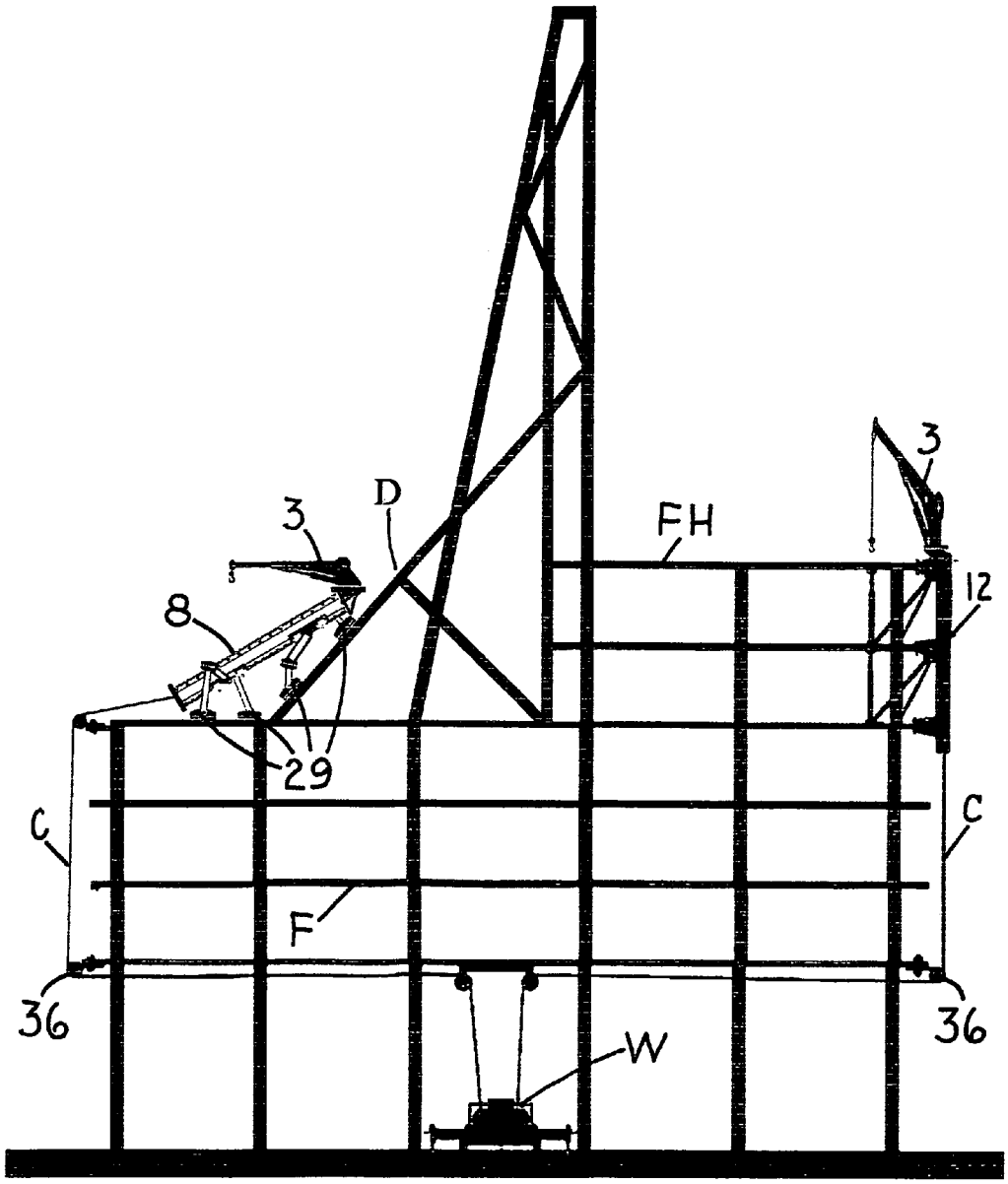
Figure 33:
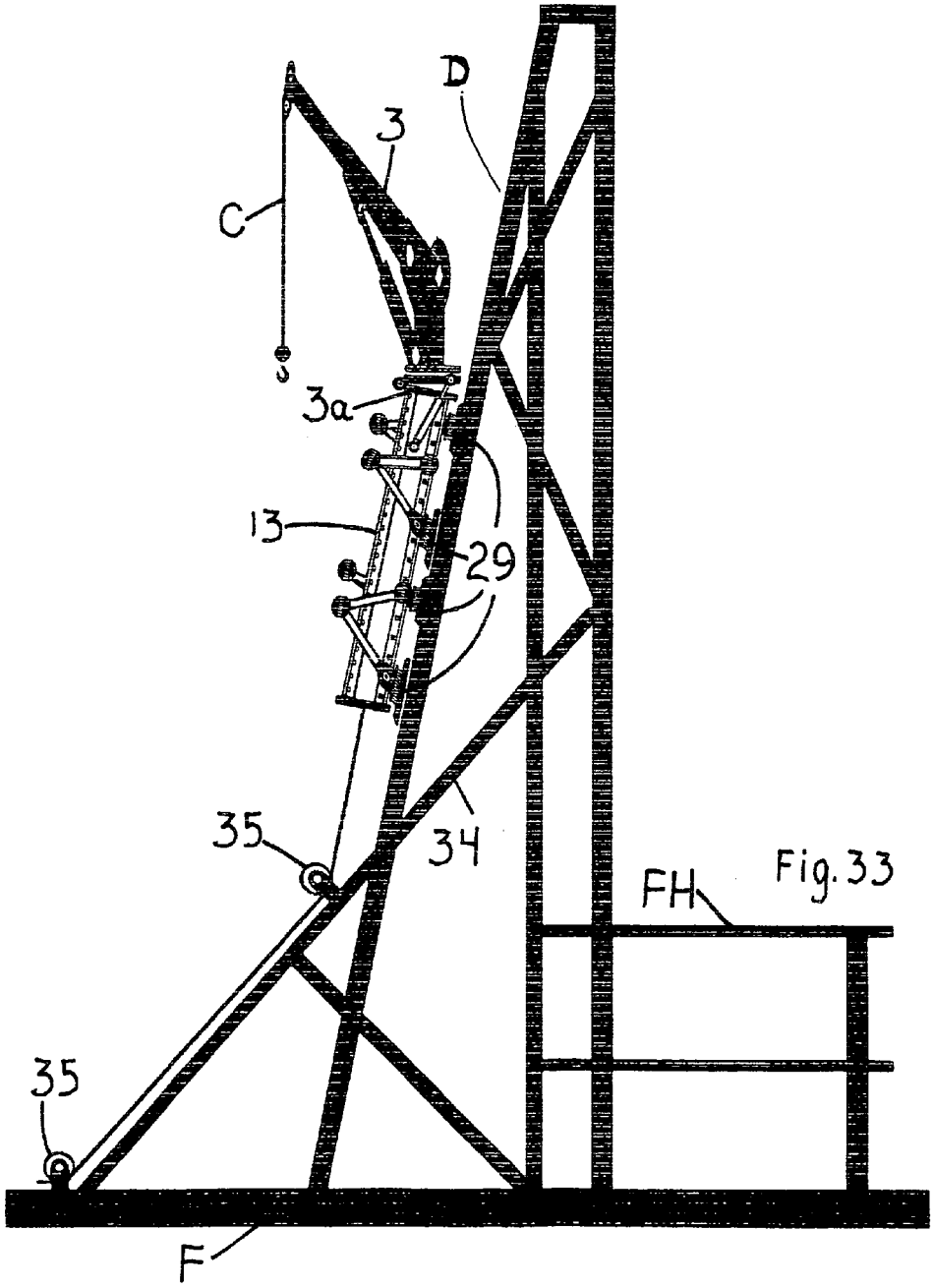
FIG. 33 is a close up of the movement of the crane of FIGS. 31 and 32.

FIG. 32 is the same view as is shown in FIG. 31 but it shows the progression and advance of the self-climbing hoist 8 having the crane 3 thereon. In this FIG. 32, the unit has just started the climb onto the diagonal D. This Fig. also shows the mechanical arms 29 which are instrumental in aiding the progression of the unit 8. At FH are shown different floor heights. The crane assembly 12 has already been installed on the opposite side of the building FIG. 33 illustrates the same view as is shown in FIGS. 31 and 32 but in an enlarged view. The self climbing hoist 13 including the crane 3 is moving along the diagonal brace D and is hoisted by the cable C along the sheaves 35. At 29 are shown the hinged support arms 29 having the attachment features shown in FIGS. 23-26. At FH is shown a building floor being located at a different height.

Figures 34, 35:
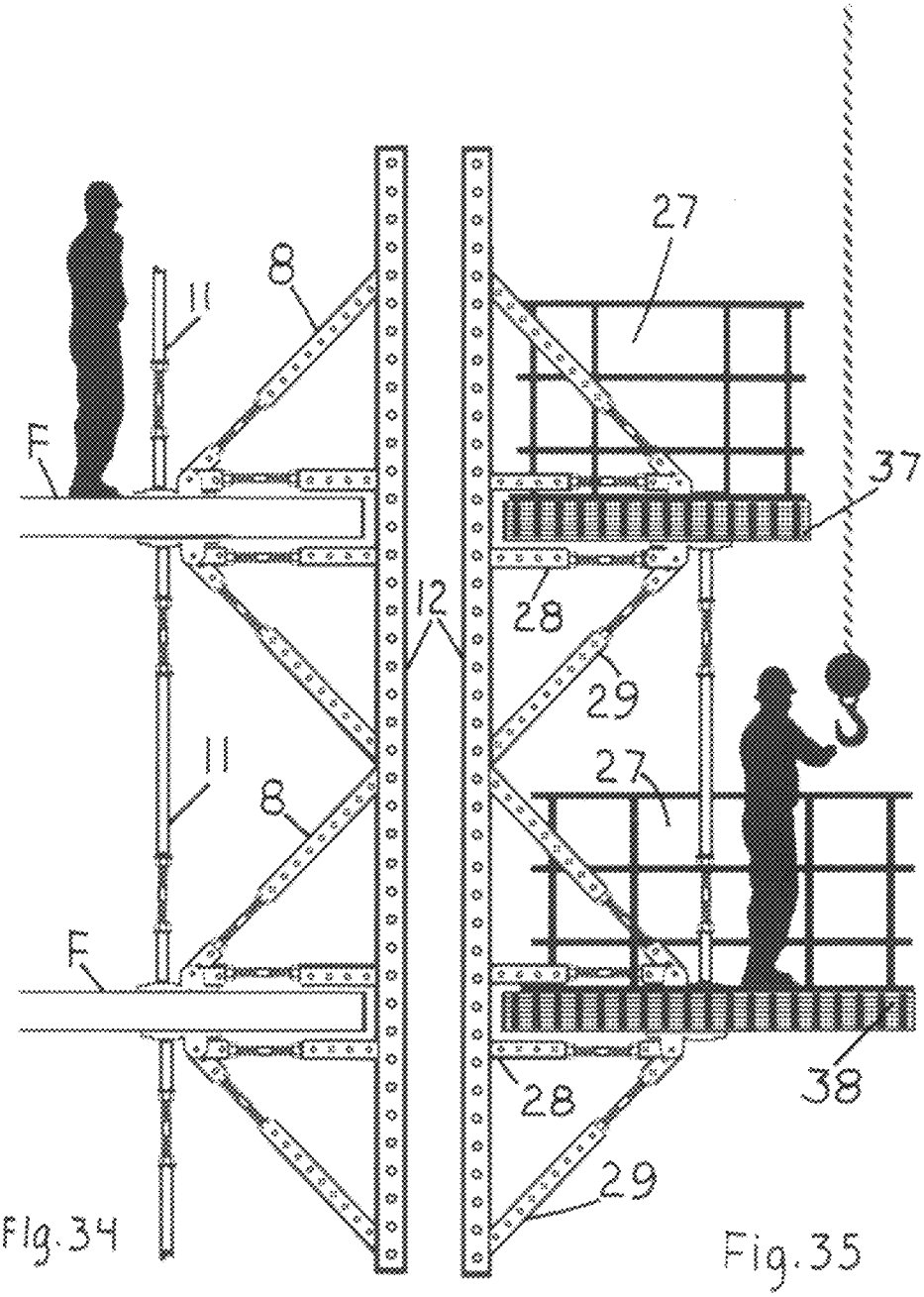
FIG. 34 illustrates a vertical mast in position on the side of a Building.
FIG. 35 shows caged platforms attached to the mast in a staggered relationship from other platforms.

FIG. 34 shows a somewhat close and side view of the main mast consisting partly of the masts 11 and 12. The mast 11 is fastened to the front edge of the floors F and is further supported by the diagonal braces 8 and the braces 9 which are the leg braces extending close to the floor F. The forwardly extending masts 12 have loading platforms attached thereto which also have the diagonal braces 8 and the floor braces 9 attached thereto for stabilizing purposes.

From FIG. 34 it can be seen that lower loading platform 46*b* extends somewhat more forwardly than the upper loading platform 46. The reason for this arrangement is that the cable C with a load thereon can easily bypass the upper platform 46 so that a load can be delivered to a lower loading platform 46*b*. The vertical braces 17 between the floors F and between the loading platforms 46 and 46*b* provide a support for an overload protection.

Figure 36:
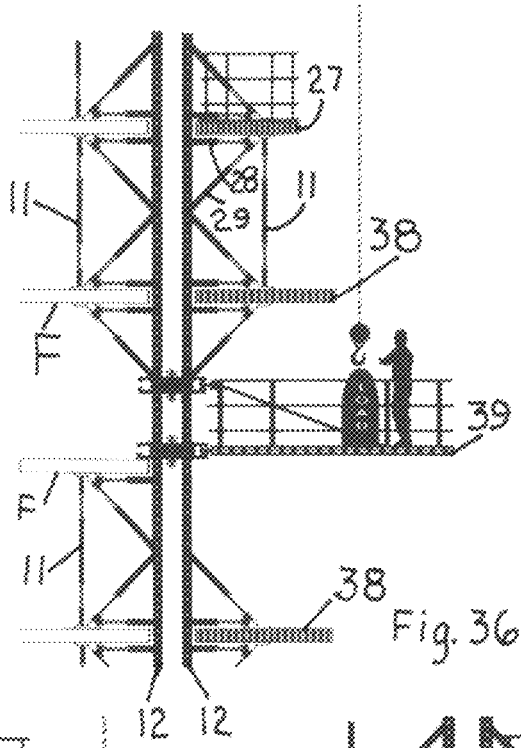
FIGS. 36-37 illustrates various combinations of staggered caged platforms relative to the building front.
Figure 37:
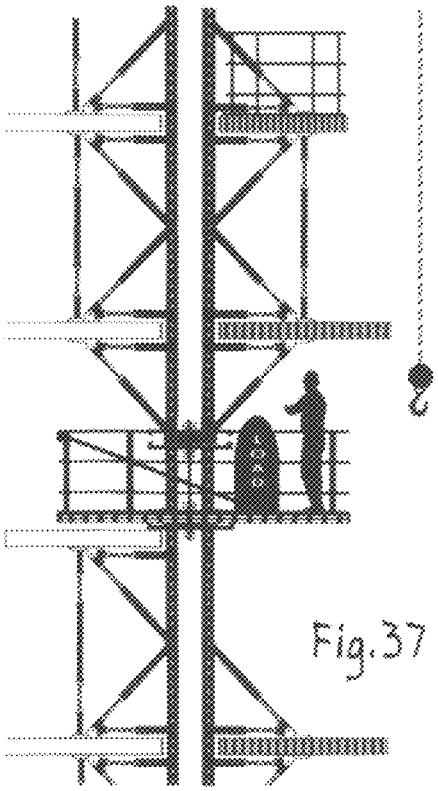

FIGS. 35-37 illustrate the same basic principle as is shown and explained with regard to FIG. 34 except that in arrangement one of the forwardly extending platforms 46*c* can be rotated around the split collar ring 40 to thereby being able to be moved in all directions as can be seen in FIGS. 36 and 37. Thereby, when a loads L are deposited on their respective loading platform 46*c* the platform can be turned so that the load cab delivered to a predetermined floor F as is shown FIG. 37.

Figure 38:
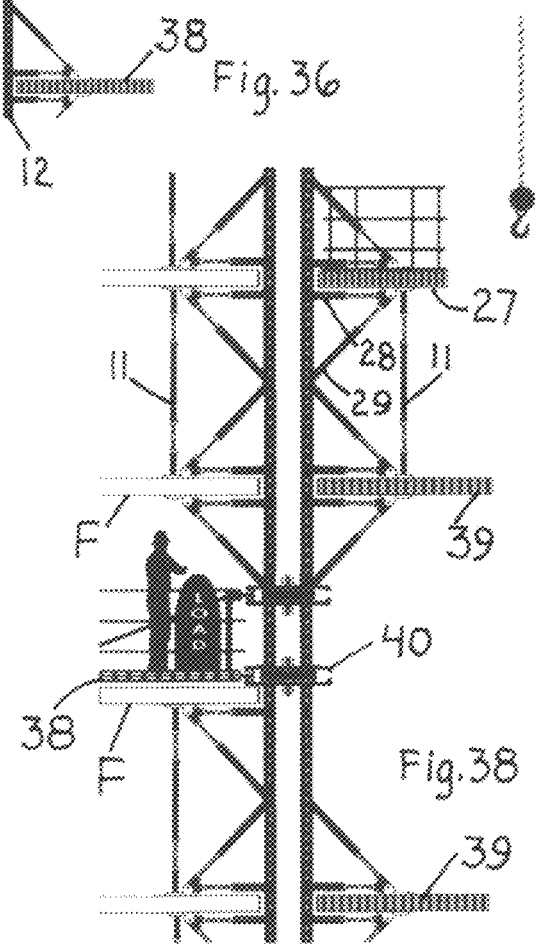
FIG. 38 shows an extended cantilevered trolley with wheels.

FIG. 38 illustrates a different loading platform consisting of longer wheeled handrail shuttle 43*a* which is similar to the loading platform 46 or 46 *c* but it is movable on a floor F once it turned into that direction. The extended wheeled handrail shuttle 43*a* has wheels 44 thereon so that it can be moved onto the respective floor F. Part of the wheeled handrail shuttle is the H-beam 41 on which the shuttle 43 is mounted. This compares to the platform apparatus P of FIG. 3. The shore jacks 42 are similar to the ones 17 shown in previous Figs.

Figure 39:
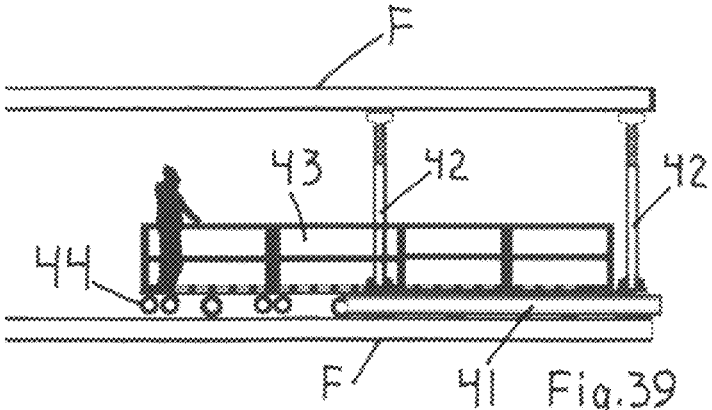
FIG. 39 shows the trolley of FIG. 39 having a front drop down deck.

FIG. 39 is a side view of a further development of the handrail shuttle 43. The front of the shuttle 43 has attached thereto the platform 46 shown in FIGS. 35-37 but is hinged thereto by way of a horizontal hinge 46*a*. The platform 46 is operated in an up and down movement by way of a winch 45 mounted on the handrail shuttle 43. The cable C from the winch 45 is trained over a fulcrum lever or hinged arm 47 and then attached to the front of the hinged platform 46.

Figure 40:
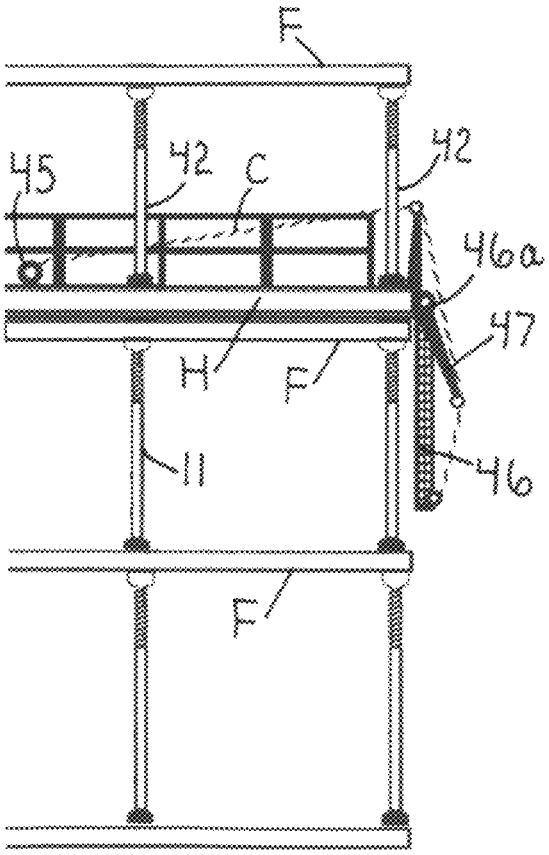
FIG. 40 is front view of the drop down deck of FIG. 40.

FIG. 40 is front view of the of the shuttle 43 with the hinged platform located in a downed position.

Figure 41:
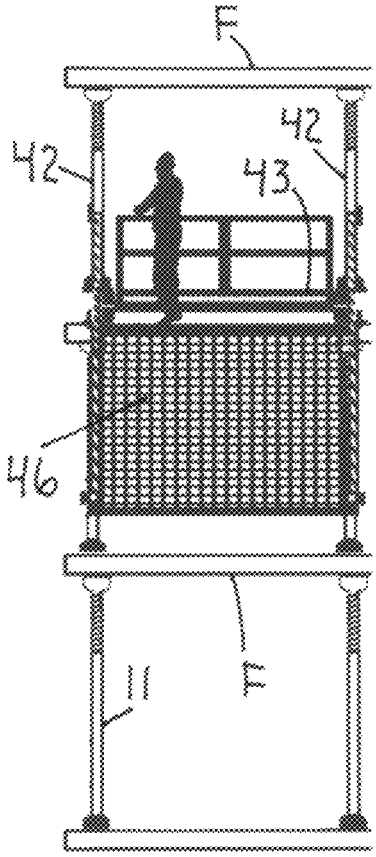

FIG. 41 illustrates a further development of the wheeled handrail shuttle 43 in a forward position past the front of the floor F so that a load can be delivered onto the platform. The wheels 44 are shown in several views in FIG. 41. Once at the rear end of the shuttle 43, the second time in the circle between the FIGS. 41 and 43 and the third time in the front view of FIG. 43.

FIG. 42 is a side view of the handrail shuttle 43*a* which is operated by the winch 48, by way of cable C and the fulcrum lever 47 and in this Fig. the hinged platform 43*a* is shown in a horizontal and load receiving position.

Figure 43:
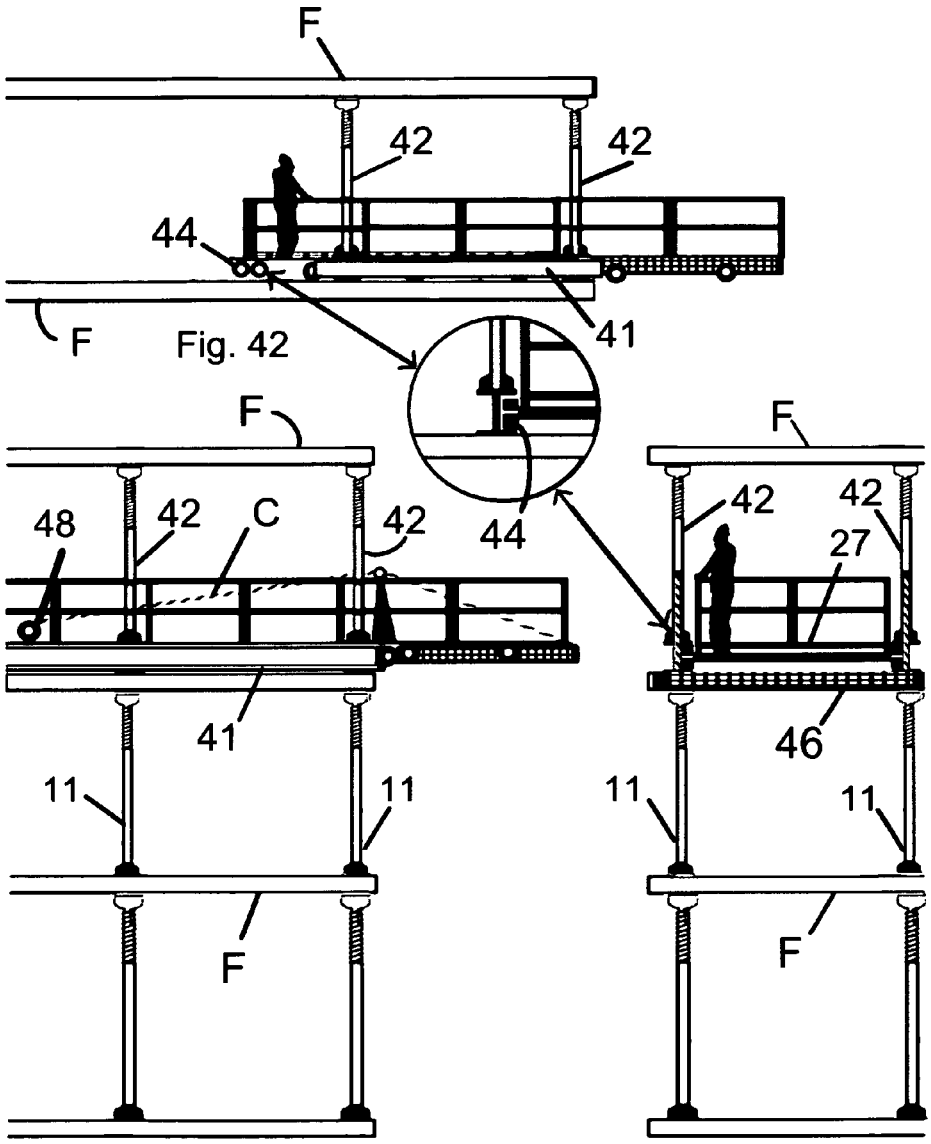
FIG. 43 is a front view of the cage of FIGS. 41 and 42.

FIG. 43 is front view of the hinged platform in up position. This view shows the platform designated as 27 because it compares to FIG. 27 wherein it is designated as 27 for the purpose of transporting personnel.

What I claim is:

1. A hoisting and placement system comprising:

a crane assembly, including a crane and a tower mast assembly, said tower mast assembly comprising at least one deck clamp having opposing deck plates for engaging a top and bottom of a floor structure of a building under construction said deck clamp being slidable within an interior of said tower mast, said deck clamp further having means for moving said tower mast relative to said deck clamp;

means for moving said crane assembly to said building under construction;

means located on said means for moving is a hoisting winch system for hoisting said crane assembly to a higher floor on said building under construction; and means for transitioning said crane assembly from a vertical position to a horizontal position on said building under construction.

2. The hoisting and placement system of claim 1, wherein said means for moving is a truck.

3. The hoisting and placement system of claim 1 including means for fastening said crane assembly to at least two floors on said building under construction.

4. The hoisting and placement system of claim 1, including all-terrain wheels on a lengthwise side of said crane assembly for moving said crane assembly on a ground or through said building under construction to different locations.

5. The hoisting and placement system of claim 1 including a tower mast extension joinable to a selected floor on said building, and means for joining said tower mast extension to said selected floor.

6. The hoisting and placement system of claim 5, wherein said crane is mounted on top of said tower mast system assembly.

7. The hoisting and placement system of claim 5, wherein said tower mast assembly is constructed of at least four masts arrangement in a square configuration.

8. The hoisting and placement system of claim 7, wherein one of said masts has a multiple of upwardly mounted elongated holes therein.

9. The hoisting and placement system of claim 8, wherein said crane assembly has means thereon for climbing said tower mast assembly up or down by engaging said elongated holes.

10. The hoisting and placement system of claim 9, wherein said means for climbing comprises gear wheels for engaging said elongated holes.

11. The hoisting and placement system of claim 5, said crane is movably mounted on top of said tower mast assembly.

12. The hoisting and placement system of claim 11, wherein said crane is mounted on a plate, and said plate is mounted to another plate on top of said tower mast assembly by way of a horizontal hinge.

13. The hoisting and placement system of claim 5, including loading platforms extending forwardly from said tower mast assembly.

14. The hoisting and placement system of claim 13, wherein said loading platforms are extending forwardly at varying distances.

15. The hoisting and placement system of claim 5, wherein mechanical arms support a personnel carrying cage.

16. The hoisting and placement system of claim 15, wherein said personnel cage is movable into different rotational directions by way of said mechanical arms.

17. The hoisting and placement system of claim 13 wherein at least one of said loading platforms is extending to an interior of said building under construction at a greater length.

18. The hoisting and placement system of claim 17, wherein said extended loading platform has wheels at a bottom thereof.

19. The hoisting and placement system of claim 18, wherein said extended loading platform has a forward section that is hinged to said extended loading platform.

20. The hoisting and placement system of claim 19, wherein said forward and hinged section is movable by way of a winch attached at a rear end of said extended loading platform.

* * * * *